United States Patent [19]

Brass

[11] Patent Number: 5,026,196

[45] Date of Patent: Jun. 25, 1991

[54] INFORMATION ORGANIZING SYSTEM

[76] Inventor: Robert L. Brass, Four Norwood La., Westport, Conn. 06880

[21] Appl. No.: 356,525

[22] Filed: May 25, 1989

[51] Int. Cl.[5] ..... B42F 3/00

[52] U.S. Cl. ..... 402/79; 281/15.1; 281/38; 283/900

[58] Field of Search ..... 281/15.1, 38; 283/900; 402/79

[56] References Cited

U.S. PATENT DOCUMENTS

| | | | |
|---|---|---|---|
| 4,221,404 | 9/1980 | Shuffstall | 283/900 X |
| 4,571,867 | 2/1986 | Williams | 402/79 X |
| 4,634,146 | 1/1987 | Yaniv | 402/79 X |
| 4,715,759 | 12/1987 | Larque | 402/79 X |
| 4,803,795 | 2/1989 | Questel et al. | 402/79 X |
| 4,842,303 | 6/1989 | Molenda | 281/15.1 X |
| 4,907,904 | 3/1990 | Baldwin | 402/79 X |

*Primary Examiner*—Paul A. Bell

*Attorney, Agent, or Firm*—Haynes N. Johnson

[57] ABSTRACT

An information organization system is provided which utilizes a series of imprinted organizational sheets which have releasable, pressure-sensitive adhesive on the lower edge of the reverse surface. These sheets are carried on a pad and are thereafter individually removed and placed upon preprinted notebook or other reference sheets and held in place by the adhesive. Since they are adhered along their lower edges, the organizational sheets can be placed in overlapping juxtaposition with only their upper areas showing; and, yet, each sheet can be read in its entirety from the top down without removing other sheets. The sheets can be adhered to, or removed from, the notebook pages or other reference sheets in any sequence.

10 Claims, 2 Drawing Sheets

INFORMATION ORGANIZING SYSTEM

FIELD OF THE INVENTION

This invention relates to information organizing systems usable in looseleaf notebooks and elsewhere. In particular, it relates to a system by which notebooks may be organized for more efficient use.

BRIEF SUMMARY OF THE INVENTION

An information organization system is provided which utilizes a series of imprinted organizational sheets which have releasable, pressure-sensitive adhesive on the lower edge of the reverse surface. These sheets are carried on a pad and are thereafter individually removed and placed upon preprinted notebook sheets or other sheets and are held in place by the adhesive. Since they are adhered along their lower edges, the organizational sheets can be placed in overlapping juxtaposition with only their upper areas showing; and, yet, each sheet can be read in its entirety from the top down without removing other sheets. The sheets can be adhered to, or removed from, the notebook pages or other reference sheets in any sequence.

The organizational sheets may include printed pointers enabling them to be adhered to the notebook or other sheets in a specified position which identifies their purpose and/or identifies a time such as an appointment time. The notebook pages are complementary to the organization sheets and are printed to identify the places where the organizational sheets are to be adhered.

DETAILED DESCRIPTION OF THE INVENTION

Figure 1:
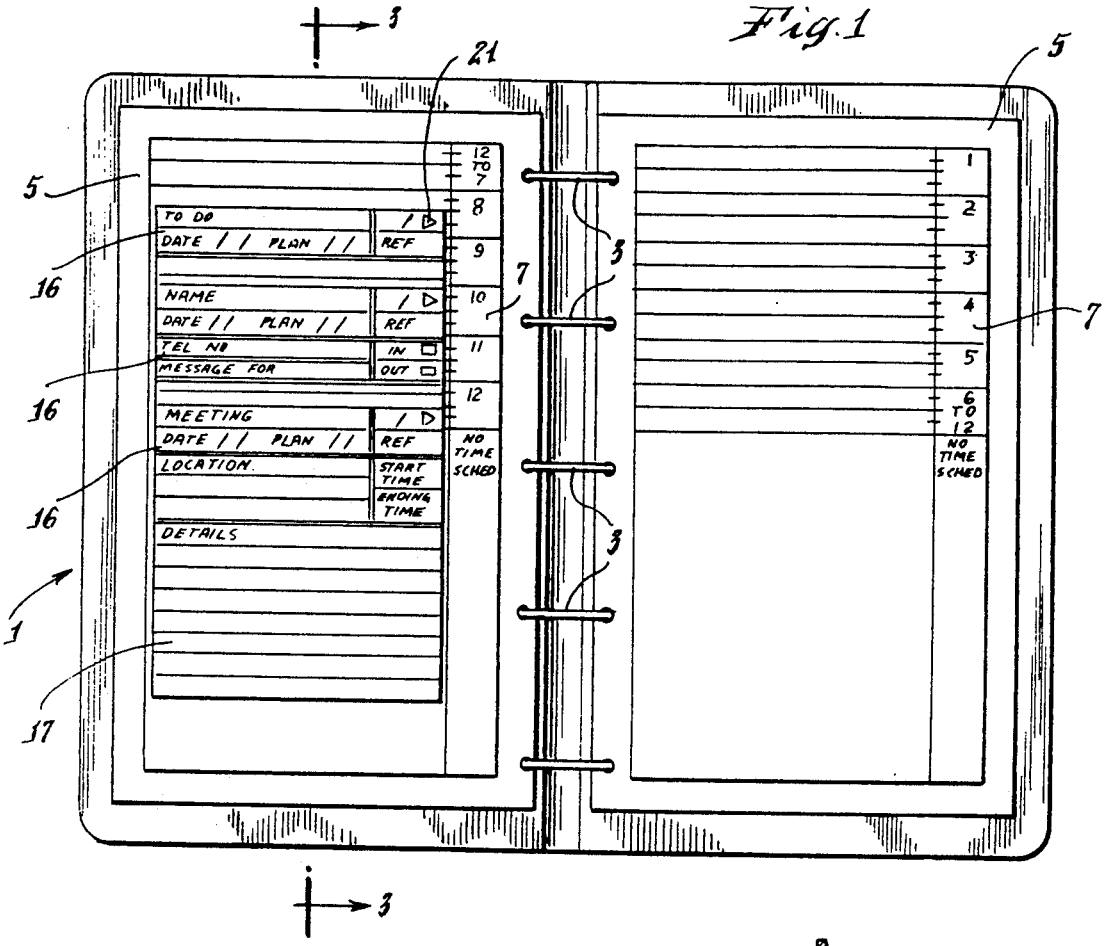
FIG. 1 is a plan view of my system used in a notebook. The notebook is in open position showing some organizational sheets adhered to notebook pages. It will be noted that pointing indicia on the organizational sheets are correlated with appointment times printed on the notebook sheets.
Figure 2:
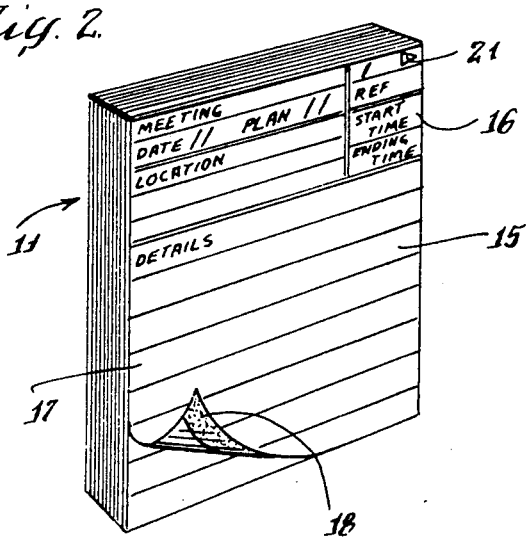
FIG. 2 is a perspective view of a pad of preprinted organizational sheets. A lower corner of the top sheet has been turned to show the releasable, pressure-sensitive adhesive along the lower edge of the back surface. This adhesive serves to hold the sheets on the pad.

A loose-leaf notebook 1 with rings 3 carries notebook pages 5. Preferably, the pages are preprinted with appointment times along their right-hand edges.

A pad 11 carries organizational sheets 15. The sheets carry releasable, pressure-sensitive adhesive 18 along the lower edges of their back surfaces. This adhesive, which may be of the type used on note pads sold as "Post-It" notes, serves to hold sheets 15 together as a pad and also serves to temporarily secure them to notebook pages 5. Sheets bearing this adhesive can be easily adhered to and removed from the notebook pages. The system provides great flexibility since sheets 15 may from time to time be moved to different positions on the notebook page, to a different type of notebook page, or to separate sheets.

Sheets 15 include upper printed area 16 and lower printed area 17. The upper area is used for matter which the user desires to remain exposed and readable when the sheets are on notebooks pages 5; it could include printed spaces for names of persons to be met with, location of a meeting, purpose of the meeting, and the like. It should also include a pointer, such as pointing indicia 21, along the right edge of the upper printed area. This permits each sheet 15 to be positioned on the note-book page with the pointer indicating an appointment time or other desired data.

The lower printed area 17 may have areas to carry specific information or, as shown, simply be lined for entering notes.

Sheets 15 should have a width such that, when adhered to a notebook page 5, they essentially fill the width of page 5 except for that portion 7 showing appointment times. Then a sheet 15 can be adhered to notebook page 5 with its pointing indicia 21 pointing to the appointment time relating to that sheet. Alternatively, the dimensioning could be such as to permit two columns of sheets 15 on one page 5. If the sheets are used in connection with charts, they would normally be considerably smaller than the charts.

It will be noted from FIG. 1 that several sheets 15 can be adhered to page 5 in overlapping, juxtaposed relationship such that only the upper printed area 16 is exposed (except for the lowermost sheet 15). As a result the subject matter of the upper printed area can be read and, if desired, the entire contents of a sheet can be read by simply bending the lower sheets downwardly. This is far more convenient to use, and an improvement over having sheets which have their adhesive along the top edge. The pages 5 should be lined to complement the vertical dimension of the upper printed area 16, so that the sheets 15 may be adhered to and removed from the pages in any sequence.

Figure 3:
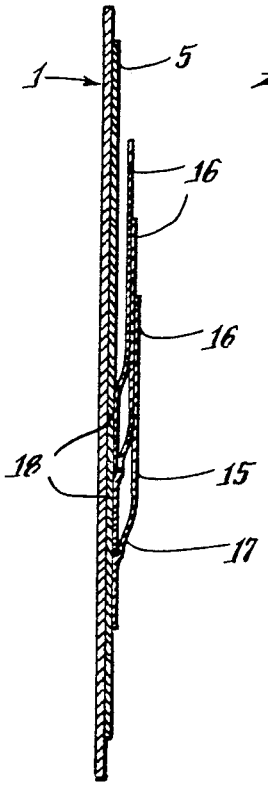
FIG. 3 is a section taken on line 3—3 of FIG. 1 showing several organizational sheets adhered to one notebook page and overlapping one another.

FIG. 3 is a cross-section showing the sheets 15 adhered to a notebook page 5 in staggered, overlapping juxtaposition. As can be seen, the upper printed area 16 of each sheet remains visible, but the lower printed areas 17 are covered (except for the lowest sheet 15). The printing on pages 5 should be so dimensioned as to provide for this spacing. Normally, the vertical width of the adhesive should be about the same as the spacing of the lines; it can, however, be slightly greater, if desired, to provide overlap between sheets and, so, slightly greater integrity.

Figure 4:
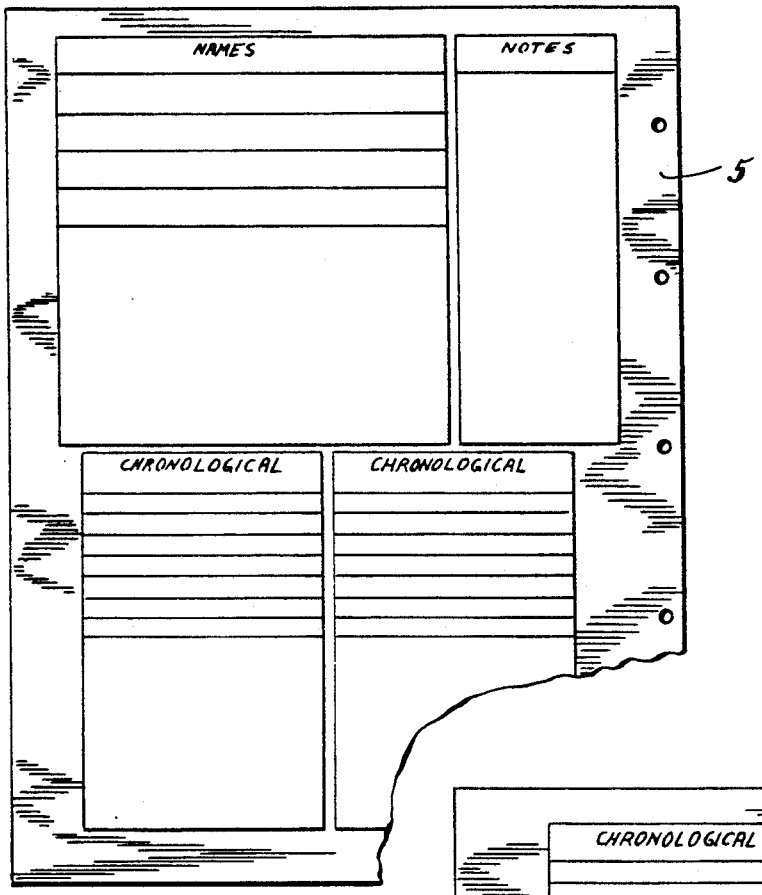
FIGS. 4 and 5 are plan views of notebook pages with different types of preprinted spaces to receive organizational sheets.
Figure 5:
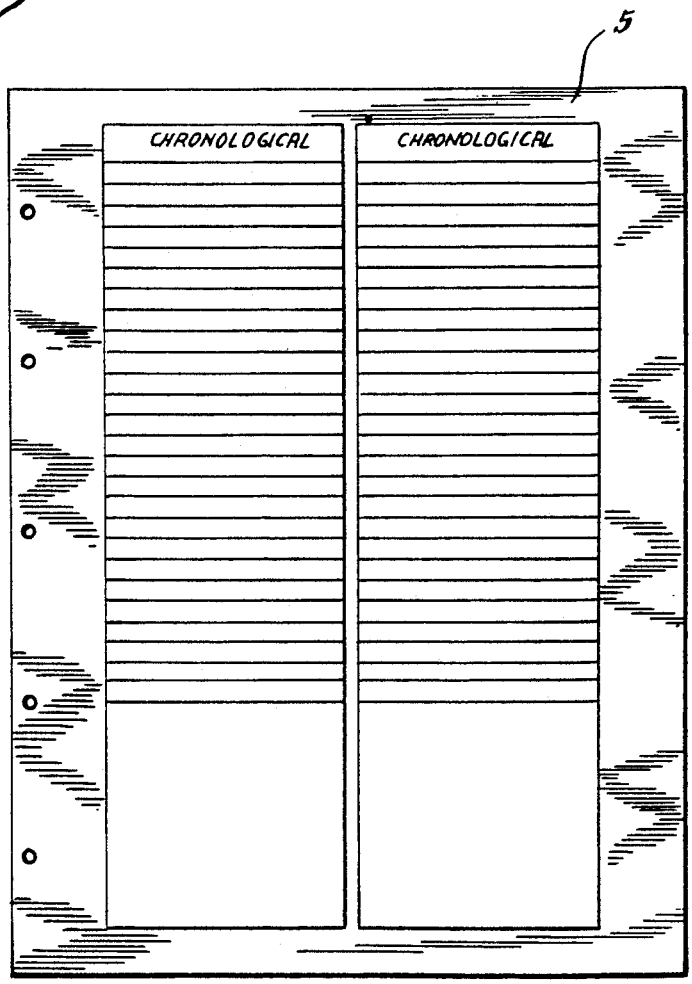

Alternative types of notebook pages 5 are shown in FIGS. 4 and 5 and bear printing for customer names or dates. These pages provide reserve space for keeping used sheets 15 in either chronological order or for keeping all used sheets for a given client or customer. Thus, the user can keep his day to day appointments on pages such as those shown in FIG. 1 and, thereafter, retain them chronologically by customer or client on a sheet such as shown in FIG. 4 or a simple single chronological file as with the sheet of FIG. 5. As with all types of notebook pages, they should be printed with spacing so dimensioned as to complement the size and printing of the organizational sheets. Since sheets 15 are removable, notebook pages 5 can be reused.

I claim:

1. A pad of organizational sheets, said sheets being adapted to be attached to a page, each said sheet having a front surface and a reverse surface, said sheets being releasably adhered to one another by releasable, pressure-sensitive adhesive on said reverse surface of each said sheet only proximate to the lower edge thereof, printed indicia on the front surface of said sheets, said indicia being so oriented that said indicia are usable when said lower edge is at the bottom, and said printed indicia being divided into an upper printed area and a lower printed area, whereby said sheets can be removed from said pad and mounted on a page in any sequence and in overlapping juxtaposition with all said upper printed portions being visible to the reader.

2. A pad of organizational sheets, said sheets being adapted to be attached to a page bearing printed data, each said sheet having a front surface and a reverse surface, said sheets being releasably adhered to one another by releasable, pressure sensitive adhesive on said reverse surface only proximate to the lower edge thereof, printed indicia on the front surface of said sheets, said indicia being so oriented that said indicia are usable when said lower edge is at the bottom, said printed indicia including a pointer proximate to the top edge and one side of said sheet and pointing in the direction of said side edge, whereby said sheets can be removed from said pad and mounted on the page in overlapping juxtaposition with the uppermost portion of said indicia on said sheets being visible to the reader with said pointer pointing to a selected portion of said printed data, and said sheets can be adhered to or removed from the page in any sequence.

3. A pad or organizational sheets as set forth in claim 1 in which said printed indicia includes an upper portion and a lower portion, said upper portion carrying information which is to always be visible to the user.

4. A pad of organizational sheets as set forth in claim 1 in which the page is a notebook page.

5. A notebook organizing system, said system including a notebook carrying a plurality of notebook pages bearing printed data, a plurality of organizational sheets, each sheet having a front surface and a reverse surface, said sheets being releasably adhered to at least one of said pages by releasable, pressure-sensitive on said reverse surface of each said sheet only in a line proximate to the lower edge thereof, printed indicia on said front surface of each said sheets, said indicia being so oriented that said indicia are readable when said lower edge is at the bottom, said pages having alignment markings thereon designating spacing of said sheets on said pages, said alignment markings being dimensioned to complement the size and shape of said sheets and said printed data thereon and being spaced from one another by a distance approximating the width of said lines of releasable pressure-sensitive adhesive, whereby said sheets can be mounted on said pages in overlapping juxtaposition, being adhered only along the lower edges thereof, with the uppermost portion of said indicia on said sheets being visible to the reader and said sheets can be adhered to and removed from said pages in any sequence.

6. A notebook organizing system as set forth in claim 5 in which that portion of said indicia visible to said reader, when a plurality of said sheets are adhered to a said page in accordance with said alignment markings, includes printed pointers directing the reader's attention to particular areas of said page, whereby said sheets may be oriented in time or task sequence on said pages.

7. A notebook organizing system as set forth in claim 5 in which said printed indicia divide said sheet into an upper printed area and a lower printed area and means are provided for spacing said sheets on said page so that only said upper printed area is visible on those said sheets which are overlapped.

8. A notebook organizing system as set forth in claim 5 in which the vertical width of said adhesive corresponds to the width of said alignment markings.

9. A notebook organizing system as set forth in claim 5 in which some of said notebook pages are so imprinted as to indicate that they are to be used for different tasks than others of said notebook pages.

10. An information organizing system, said system including at least one page bearing printed data, a plurality of organizational sheets, each said sheet having a front surface and a reverse surface, said sheets being releasably adherable to said page by releasable, pressure-sensitive adhesive on said reverse surface of said sheet only proximate to the lower edge thereof, printed indicia on said front surface of each said sheets, said indicia being so oriented that said indicia are readable when said lower edge is at the bottom, said indicia having uppermost and lowermost portions, said page having alignment markings thereon designating spacing of said sheets on said pages, said alignment markings being dimensioned to complement the size and shape of said sheets and said printed data thereon and being vertically spaced from one another by a distance approximating the vertical width of said uppermost portion, where said sheets can be mounted on said page in overlapping juxtaposition with the uppermost portion of said indicia on said sheets being visible to the reader and said sheets can be adhered to and removed from said page in any sequence.

* * * * *